US006394280B1

(12) United States Patent
Gassner et al.

(10) Patent No.: US 6,394,280 B1
(45) Date of Patent: May 28, 2002

(54) DEVICE FOR SEPARATING MIXTURES OF VALUABLE SUBSTANCES

(76) Inventors: Benno Gassner; Benno Gassner, Jr., both of 15, 85655 Goggenhofen (DE)

( * ) Notice: Subject to any disclaimer, the term of this patent is extended or adjusted under 35 U.S.C. 154(b) by 0 days.

(21) Appl. No.: 09/762,500

(22) PCT Filed: Apr. 21, 1999

(86) PCT No.: PCT/EP99/02779

§ 371 (c)(1),
(2), (4) Date: Mar. 21, 2001

(87) PCT Pub. No.: WO00/09273

PCT Pub. Date: Feb. 24, 2000

(30) Foreign Application Priority Data

Aug. 11, 1998 (DE) ..... 198 36 344
Oct. 12, 1998 (DE) ..... 298 18 198 U

(51) Int. Cl.[7] ..... B07C 5/36
(52) U.S. Cl. ..... 209/616; 209/615
(58) Field of Search ..... 209/615, 616, 209/644, 903, 932, 917

(56) References Cited

U.S. PATENT DOCUMENTS 972,294 A * 10/1910 Tompkins ..... 209/616
1,209,654 A * 12/1916 Anderson ..... 209/616
2,915,180 A * 12/1959 Macgillivray ..... 209/616
3,757,946 A * 9/1973 Berkowitz et al. ..... 209/120
4,279,740 A 7/1981 Isogaya
4,699,275 A * 10/1987 Holsonbake ..... 209/616
5,476,037 A * 12/1995 Nagaoka ..... 99/584

FOREIGN PATENT DOCUMENTS

DE 43 25 835 A1 2/1995
FR 2 392 797 12/1978
GB 2 063 106 A 6/1991

* cited by examiner

*Primary Examiner*—Michael R. Mansen
*Assistant Examiner*—Joseph C Rodriguez
(74) *Attorney, Agent, or Firm*—William W. Jones

(57) ABSTRACT

A device for removing flat materials from a mixture of valuable substances comprises a conveyor (1) on which the substance mixture is conveyed, and an extractor for extracting flat materials from the substance mixture in an extraction zone. The extractor comprises extracting prongs (4) which are provided on a revolving transporter (3) which is deflected at least at two points of deflection, with the materials which have been picked up being discharged in a discharge zone.

16 Claims, 8 Drawing Sheets

DEVICE FOR SEPARATING MIXTURES OF VALUABLE SUBSTANCES

A number of different devices for separating mixtures of valuable substances are known. It frequently is the case that certain valuable substances are to be separated from a mixture of valuable substances so that they can be subjected to further processing. However, there are also cases in which certain substances which render the further processing of the mixture difficult or even impossible are to be removed from the substance mixture.

When valuable substances are collected in bags or cardboard boxes and are automatically further processed by means of machines, the bags or cardboard boxes first have to be opened and, in most cases, then have to be removed from the substance mixture. Particularly in the case of plastic bags, recycling is often desired. Also larger foil portions in the substance mixture can be subjected to recycling. Thus, the problem presents itself that the packaging of the substance mixture, normally bags or cardboard boxes, is to be removed from the substance mixture. In this process, other substances, such as larger foil portions, should also be removed and cardboard boxes should be separated from the delivered paper.

The WO 95/07769 discloses a device for removing flat, light substances, such as plastic foils, comprising an air sifting. The substance mixture is conveyed by a conveyor belt to a discharge point and, when falling down, air is applied thereto by a blower. The air flow generated by the blower is dimensioned such that only light, flat materials are swept along by it, whereas heavier, more compact materials drop off the discharge point onto a second conveyor belt and are conveyed away by the same. The light, flat materials are swept along by the air flow to a discharge zone in which the materials descend with increasing distance from the blower and fall onto another conveyor belt by which they are conveyed away. Foils which do not contain any further substances and lie on top of the substance mixture can sufficiently be separated in this way. However, this device is not suitable for conveying away bag-like foils which still contain heavier substances, or foils which are at least partly buried by other substances.

It is the object of the invention to provide a device by means of which foils or cardboard boxes as well as similar substances and, if required, also other substances can specifically be removed from a mixture of valuable substances.

This object is achieved by the features of claim 1. According to the invention, a device for removing flat materials from a mixture of valuable substances comprises a conveying means by which the substance mixture is conveyed, and an extraction means for extracting the flat materials from the substance mixture in an extraction zone, with the extraction means comprising extracting prongs which are provided on a revolving transport means deflected at two points of deflection. The materials which have been picked up are discharged in a discharge zone.

Advantageously, the device can also remove smaller portions of foils or the like. The construction and setting-up of the device determines which material of which size is to be removed.

For discharging the materials, the transport means can be deflected at the two deflection points having a different deflection radius. The effect of this is that the extracting prongs are differently spread. This different spreading enables or facilitates the discharge of materials which have been picked up. Once the materials have been picked up by the prongs, they are, to a certain extent, stuck in the prongs.

When the prongs move relative to each other, for example due to a spreading in the deflection point, the materials come off the prongs more easily, in particular, if the prongs are moved back again after the spreading, as is the case when they pass through the deflection point. It has proved to be of advantage to apply different deflection radii. When describing the Concrete embodiment, this will still be discussed in greater detail.

The dimensioning of the deflection radii has a considerable influence on the mode of operation of the device. The deflection radii do not only influence the spreading of the prongs but also the guiding of the prongs in the extraction zone. In the case of a large radius in the extraction zone, the extracting prongs are in contact with the substance mixture for a greater length of travel before being further transported. Of course, also the alignment of the prongs with respect to the substance mixture is influenced by the deflection radius and the arrangement of the deflection means Furthermore, if the deflection radius of the lower deflection means is large, the extracting prongs are deflected more slowly so that a smaller number of unwanted substances is picked up along with the materials to be extracted, since the materials are held for quite some time in a position in which the substances can drop. Bags, in particular, are held or transported for quite some time in a position which enables them to be emptied. On the other hand, by a fast deflection of the extracting prongs, the extracted materials, when being transported upwards, would quickly reach a position in which unwanted substances that have been picked up can no longer fall down.

The same effect can, of course, be achieved when the prongs are moved appropriately by some means. For instance, the prongs can be tilted by a tilting means or shifted by a shifting means.

Furthermore, for the discharge, a blower may be provided which is capable of blowing on the extracted materials through nozzles. These measures can also be combined with other described measures for discharging the materials. A plurality of nozzles may be provided at different positions. It has proved successful to arrange them in the area of the extracting prongs. A plurality of nozzles may be provided over the width of the transport means.

A plurality of nozzles may also be arranged in the transport direction. A whole array of nozzles may be provided so as to blow away the materials in the discharge zone. For realizing the nozzle arrangement, hollow bars having blow-out openings may be provided. These hollow bars extend over the width of the transport means or also alongside the transport direction, with an arrangement of the blow-out openings in the area of the prongs being basically advantageous, since the materials have to be separated from the prongs. Of course, such bars may also be arranged at an angle to the transport means.

The blow-out direction of the nozzles can be made to be adjustable. This adjustment may be provided individually for each nozzle or for a whole group of nozzles, e.g. by pivoting a nozzle bar.

For further conveying the discharged materials, it has proved successful to first guide them to a baffle plate so that they slide down this plate and are then conveyed on by a suction means or another conveying means, such as a conveyor belt.

A conveyor belt provided for the further conveyance may be inclined upwards in the transport direction so that materials which have been taken up but shall not be conveyed on slide down and are, for example, again supplied to the substance mixture. For further conveying the flat substances or materials to be conveyed away, the conveyor belt can be provided with knobs which may have a tapered tip.

For cleaning the extracted materials, a blower can be provided which blows on the materials through nozzles. For reasons of expediency, the nozzles are arranged behind the extraction zone. The nozzles can be arranged at different positions, and the blow-out direction of the nozzles can be adjustable so that blowing on the extracted materials can be effected as optimally and completely as possible.

The substances which have been blown off can fall down back onto the conveying means by gravity or can be sucked off by a suction means. However, these measures can also be combined and the substances can be separated in this manner. Then, the heavier substances fall down and the lighter substances, e.g. small rests of foils which initially adhere to the extracted materials, can be sucked off by a suction means and can be further processed. In this area, baffle sheets may be provided at which the heavier substances rebound, and only lighter substances are subjected to a removal by suction.

Removing the materials by suction can be assisted by the arrangement of nozzles and by the blowing out, e.g., of air. Due to this, the materials come off the transport means more easily and can be better sucked off.

Advantageously, the extracting prongs are pivotable. Pivoting can be effected via a pivoting means so as to improve the extraction and discharge of materials and to enable larger objects to pass, if required. However, it is also possible to use simple resilient prongs which pivot when a predetermined release force is applied so as to prevent the system from being damaged or blocked. This will still be elaborated on in the description of the figures. So-called resilient prongs can also be deflected to the side and can be used advantageously. The extracting prongs can be formed in a bent manner.

Furthermore, the extracting prongs or at least their tips may be designed in the form of a knife so as to slit open materials, such as foils, when they are being picked up. This also facilitates the discharge, since the materials can come off the prongs more easily when they do not cling to them.

The distance of the extracting prongs with respect to each other in the transport direction or transverse thereto can, just as the length of the prongs, be adjustable according to the demand made on the device. Different prongs may also be mountable at different positions so that the device can be adapted to different demands.

The extracting prongs may be straight, curved or they may have any other shape. A shape which is not straight and which is designed such that the materials are urged to the outside has proved to be of advantage. This will be explained in greater detail by means of an embodiment. Such an effect can, in principle, be achieved by a shape in which the outer portion of the prongs is, with respect to the inner portion, displaced against the transport direction, that is to say displaced backwards with respect to the transport direction. However, one could also imagine different designs which ensure that, when the prongs are moved by the substance mixture, this mixture, i.e. the substances or materials to be extracted, is urged outwards.

In the extraction zone, one or also a plurality of strippers may be provided which can be pivotable. Between stripper and extracting prongs passing by, there may be a predetermined distance which is adjustable, if required. Yet, the stripper may also overlap the extracting prongs passing by. In this case, however, either the extracting prongs or the stripper, and, if required, both elements have to be pivotable, or the path of the extracting prongs has to go past the stripper. By the stripper, unwanted substances which have been picked up along with the extracted materials can be stripped off.

Above the conveying means and in front of the transport means carrying the extracting prongs, a pivotable baffle sheet can be provided which may have prongs. It is the purpose of the baffle sheet to form an intake zone for the material to be extracted and to loosen the delivered substance mixture, if required, as well as to prevent foils and the like from getting entangled in the extraction zone. The height of the baffle sheet above the conveyor belt on which the substance mixture is delivered is advantageously adjustable. Also the distance of the baffle sheet from the transport means for conveying away the extracted materials is adjustable.

So as to prevent the device from being blocked when more solid, larger objects are delivered, the baffle sheet should make way when a predetermined force is exceeded. This can be achieved by a pivoting movement, but also by a linear guidance upwards.

It has proved successful if the transport means and the conveying means work in opposite directions and the delivered substance mixture in a way comes towards the extracting prongs.

In spite of the baffle sheet, the device could be blocked upon delivery of bulky materials, if these materials are seized by the extracting prongs but cannot be transported away. The likelihood of a blockage is reduced by resilient prongs which can give way. However, so as to ensure a more reliable, continuous operation of the device at all events, it is, in the case of the risk of a blockage, advantageous if, at least in the area of the extraction zone, the transport means can be moved from its normal position further away from the conveying means.

This can be achieved in that at least a part of the transport means is linearly moveable or in that at least a part of the transport means is pivotable. However, it is also possible that at least the whole transport means is pivotable.The device shall give way when a predetermined force is exceeded. If pivoting is realized, the pivot axis can be selected to be at a distance from the center of gravity such that the device is brought into its operating position by gravity, and the force causing the pivoting has to act against the force of gravity. The transport means, but also the holding-down appliance, can be pivoted by a suitable selection of the pivot axes due to the force built up by the delivered object alone. The elements to be pivoted may also be biased by springs.

However, also a control by sensors may be provided by which, upon detection of the risk of a blockage, at least a part of the device or the holding-down appliance is caused to move away from the conveying means by actuators.

The blowers used can generate a pulsating air flow or the air flow can be discharged by a pulsating means in a pulsating manner through the nozzles. The pulsation will particularly make flat materials vibrate and will thus enable them to come off more easily. Individual nozzles or nozzle groups are capable of being switched off and it may be possible to apply a pulsating air flow to certain nozzle groups and a continuous air flow to others. The cross section of the nozzles may have a round, slotted or cross-slotted shape. Also other cross sections can produce good results depending on the type of the materials.

Instead of the blowers or in addition to the same, a means for ejecting fluids can be employed. The effect achieved by the ejection of fluids, such as water, is basically the same as that achieved by the blowers. However, in addition, a cleaning is achieved and the materials are moistened, which may be desired for the further processing.

Individual nozzles or nozzle groups can, depending on the materials and the conveying task, be capable of being aligned and switched so that blowing can, for example, be effected only from selected nozzles at a predetermined angle.

In the embodiments described in the following, the device is designed to remove flat materials from a mixture of valuable substances. However, the device may also be used to additionally extract certain other materials, such as hollow bodies, from the mixture of valuable substances. For this purpose, the extraction means is set up such that also these materials are extracted and conveyed away. When the materials which have been picked up are discharged, a separation takes place which can be effected by a known air sifting but also by other methods. Frequently, the materials can already easily be separated by the different trajectories of the discharged materials.

The pick-up and discharge behavior of the device can be improved by the following features. The extracting prongs may, in their bottom portion, be provided with a covering so that only the tips of the extracting prongs project. This covering may be cylindrical or frustoconical. In the latter case, the portion having the larger diameter is provided in the root of the extracting prongs and the portion having a smaller diameter is provided in the upper portion of the extracting prongs. The covering may also be formed by a plate-like element and a subsequent tubular element. The covering may also be formed integrally with the extracting prongs. For reasons of expediency, the root portion of the extracting prong, in which a spring may be provided (resilient prong), is covered by the covering so as to prevent extracted materials from getting stuck in the root portion.

The covering achieves the effect described in the following. The materials which have been picked up rather remain in the upper portion of the extracting prongs, since their lowering is prevented by the step formed by the covering. The frustoconical shape furthermore has the effect that any materials which may have reached the bottom portion nevertheless can come off again more easily, since the clear space increases towards the top.

On the discharge side of the transport means, the device may have one or plural rotatable rolls or rollers at which objects dropping down roll off either clockwise or counter clockwise. In this manner, flat materials can be prevented from falling back onto the conveying means and can be further transported by the transport means. Due to the fact that the roll or roller is rotatably supported, objects cannot remain thereon. So as to reliably ensure further transporting of these objects by the extracting prongs and prevent them from falling back onto the conveying means, sheets and/or guides can be provided which may also be resilient or pivotable or also displaceable so as to reliably avoid blockage of the device. These sheets or guides may be provided with blade-like ripping means which contribute to a reduction of the materials in size or to the ripping open of closed objects. Such a construction will be described in greater detail by means of an embodiment.

In the following, the invention will be described in greater detail by referring to preferred embodiments thereof.

Figure 8:
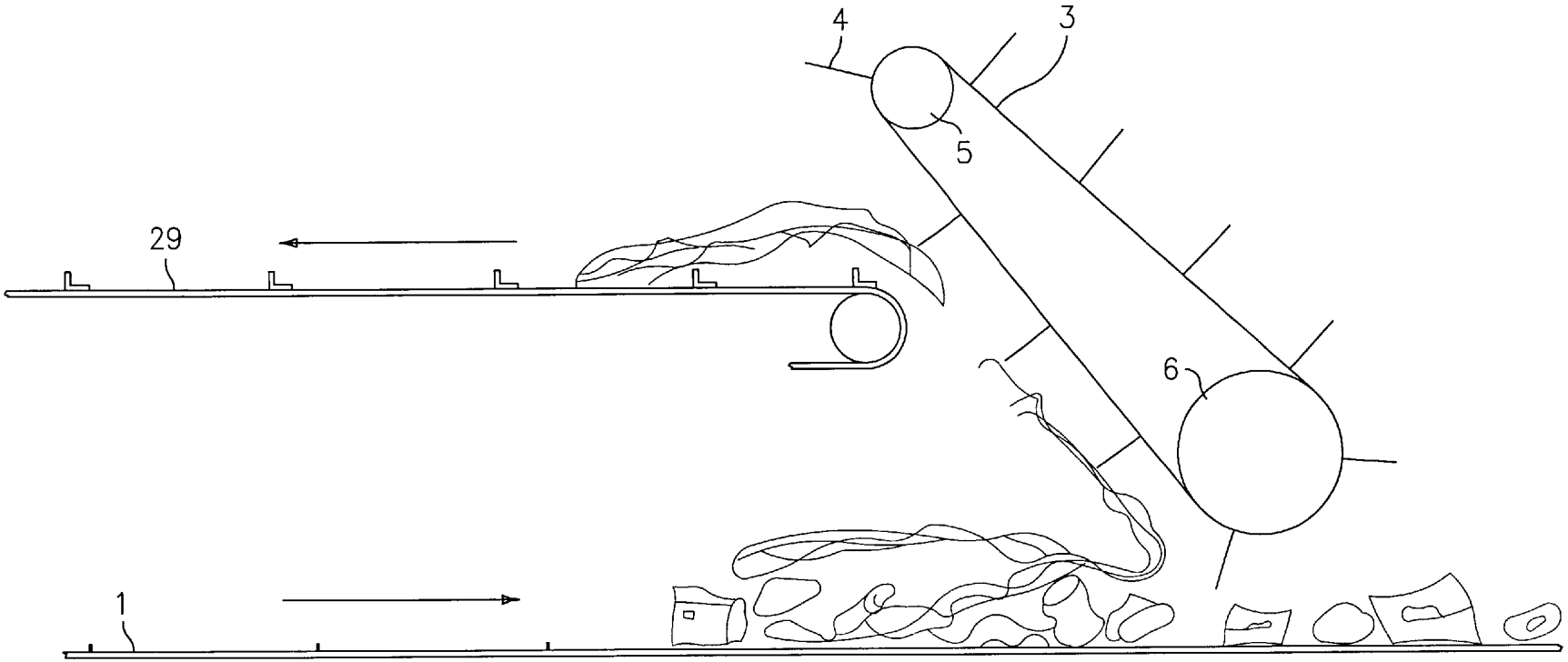

FIG. 8 schematically shows a further variant of the device.

A mixture of valuable substances, which is not represented, is conveyed on a conveying means 1 from the left-hand side to the right-hand side. The device has a transport means 3 on which extracting prongs 4 are provided and which is deflected via deflection means 5, 6. The transport is effected to the right, i.e. clockwise, so that, in the lower area, i.e. in the extraction zone, the extracting prongs 4 are moved contrary to the conveying means. The tip of the extracting prongs 4 is bent in the transport direction, by which a better extraction of the materials to be picked up is achieved. The extracting prongs 4 are formed as resilient prongs which, when a predetermined force is exceeded, pivot away with their tip to the right, that is to say against the transport direction to the back, and, if required, to the side.

In this embodiment, a blower 11 is arranged inside the transport means. This blower is connected via pressure lines 12 with nozzle bars 8, 9, 10 which are provided with nozzles for blowing out air in the direction indicated by the arrows.

The transport means is pivotably supported on a pivot axle 13 by means of a bearing block 25. On the side to the right of the transport means 3, a receiving means is provided for receiving the materials picked up and discharged again by the transport means 3. This receiving means comprises a baffle plate 14 followed by the intake 17 of a suction means 26. By this suction means 26, light, flat materials can be removed by suction. Substances carried along with the flat materials fall down when they hit the baffle plate 14 and, if possible, slide down onto a conveyor belt 16 via the chute 15. Heavy substances which are not carried along by the air blown out from the nozzle bars 9, 10 fall down directly onto the conveyor belt 16. Substances which lie on the extracted materials and are carried along with the foil are, just as light substances carried along by the air flow, flung over the baffle plate 14 and fall down onto the conveyor belt 16 behind the intake 17 of the suction means 26.

The distance between the transport means 3 and the receiving means is adjustable.

For the further separation, it can be provided that the heavy substances as shown do not fall down onto the conveyor belt 16, but are conveyed away by a separate conveying device so as to be, for example, subjected to further processing. In this manner, for example, hollow bodies, such as bottles, can be removed. Of course, the transport means 3, in particular the distance between the extracting prongs 4 and their length, can be adjusted in such a manner that also the heavy objects to be extracted are transported along.

As regards the lighter substances, it can be proceeded in a similar manner. These can also be conveyed away separately. Since, in the case of the shown device, a fluid is blown at the materials, a usual air sifting can easily be performed.

The mode of operation of the device will be explained in detail further below.

On the left-hand side of the transport means, another unit is pivotably supported on a pivot axle 32 by means of a carrier 18 adjustable in its effective length. This unit has a baffle sheet 19 with prongs 20, as well as another nozzle bar 7 having further nozzles and being supplied by the blower 11. Moreover, a stripper 21 is provided which is arranged opposite to the extracting prongs 4 and whose tip points to the tip of the extracting prongs 4. This stripper 21 is elastically mounted and will, when a release force is exceeded, pivot away to the left against the force of a spring, that is to say with its tip upwards. In the upper area of the unit, a suction means 22 is provided whose function will be explained further below.

Figure 1:
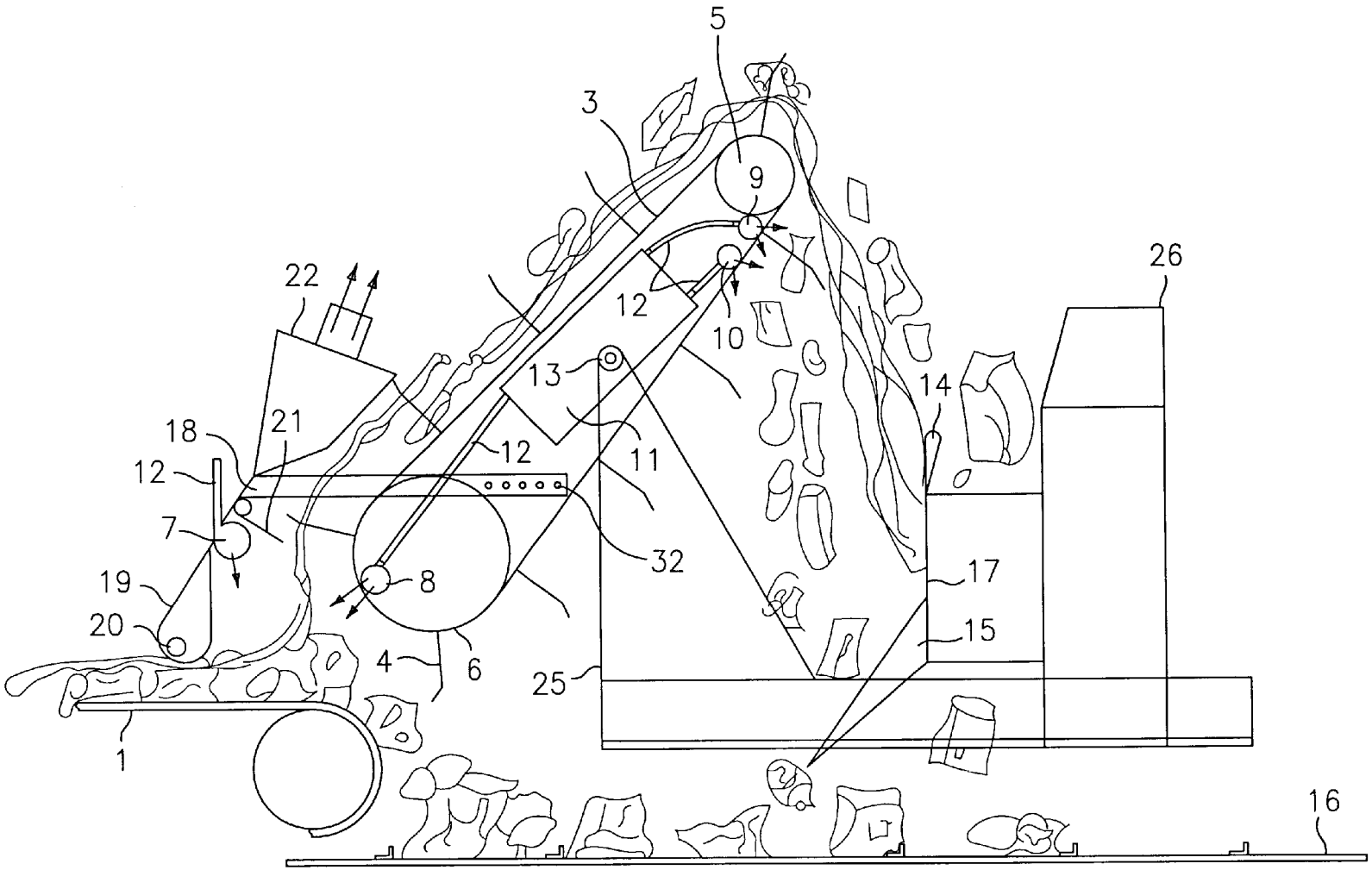
FIG. 1 is a schematic side view of the device.
Figure 2:
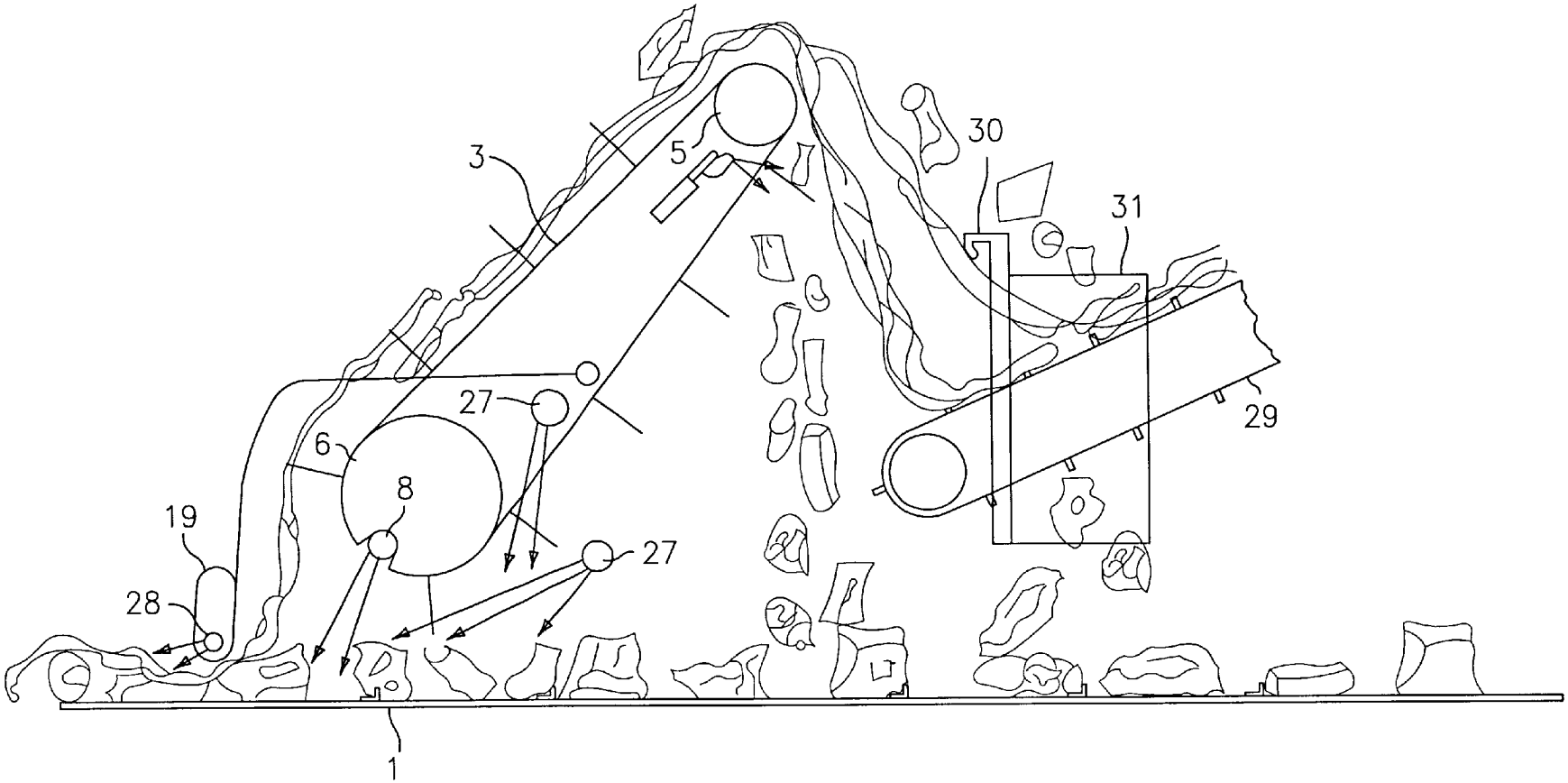
FIG. 2 is a variant of the device shown in FIG. 1.

FIG. 2 shows a variant of the device represented in FIG. 1. This variant only differs from FIG. 1 in the extraction zone and therefore only this zone is represented in detail. The remaining construction of the device corresponds to the device according to FIG. 1. In the lower area to the right of the lower deflection means 6, that is to say in front of the lower deflection means 6 when viewed in the transport direction, this variant comprises two further nozzle bars 27 which have nozzles whose air flow is directed to the conveying means 1 diagonally forwards, that is to say against the transport direction. This air flow helps to lift up the flat materials from the mixture of valuable substances and generates, in the area of the conveying means around the deflection means 6, an upwardly directed air whirl turning clockwise. Furthermore, in the area of the baffle sheet 19, a nozzle bar 28 is provided whose nozzles are primarily directed forwards so as to loosen the mixture of valuable substances and to thus also facilitate the removal of the flat materials. In the case of other mixtures of valuable substances it may be of advantage to align this nozzle bar 28 backwards so as to improve the extraction of the materials by an air flow directed backwards.

Another difference over the device according to FIG. 1 consists in that no second conveyor belt 16 is provided. Rather, the further conveyance of the substance mixture is effected by the conveying means 1, as well. Although the arrangement of the conveyor belt 16 below the conveying means 1, as shown in FIG. 1, facilitates the conveyance of bulky materials, this does also not constitute a problem in the variant according to FIG. 2 due to the fact that the transport means is pivotable. The mode of operation of the device will be elaborated on in detail further below. Moreover, the materials to be removed are not conveyed away by a suction means but by a conveyor belt 29. For receiving the materials to be removed, such as foils, a baffle plate 30 is provided. In front of this baffle plate 30, the foils fall down onto the conveyor belt 29 or first hit the baffle plate 30 and then slide onto the conveyor belt 29. Heavier objects fall down onto the conveying means 1 in front of the conveyor belt 29. Lighter objects and objects which are carried along on the extracted materials are flung over the baffle plate 30, are guided past the right- and left-hand side of the conveyor belt 29 by a diverter 31 and then drop onto the conveying means 1.

Figure 3:
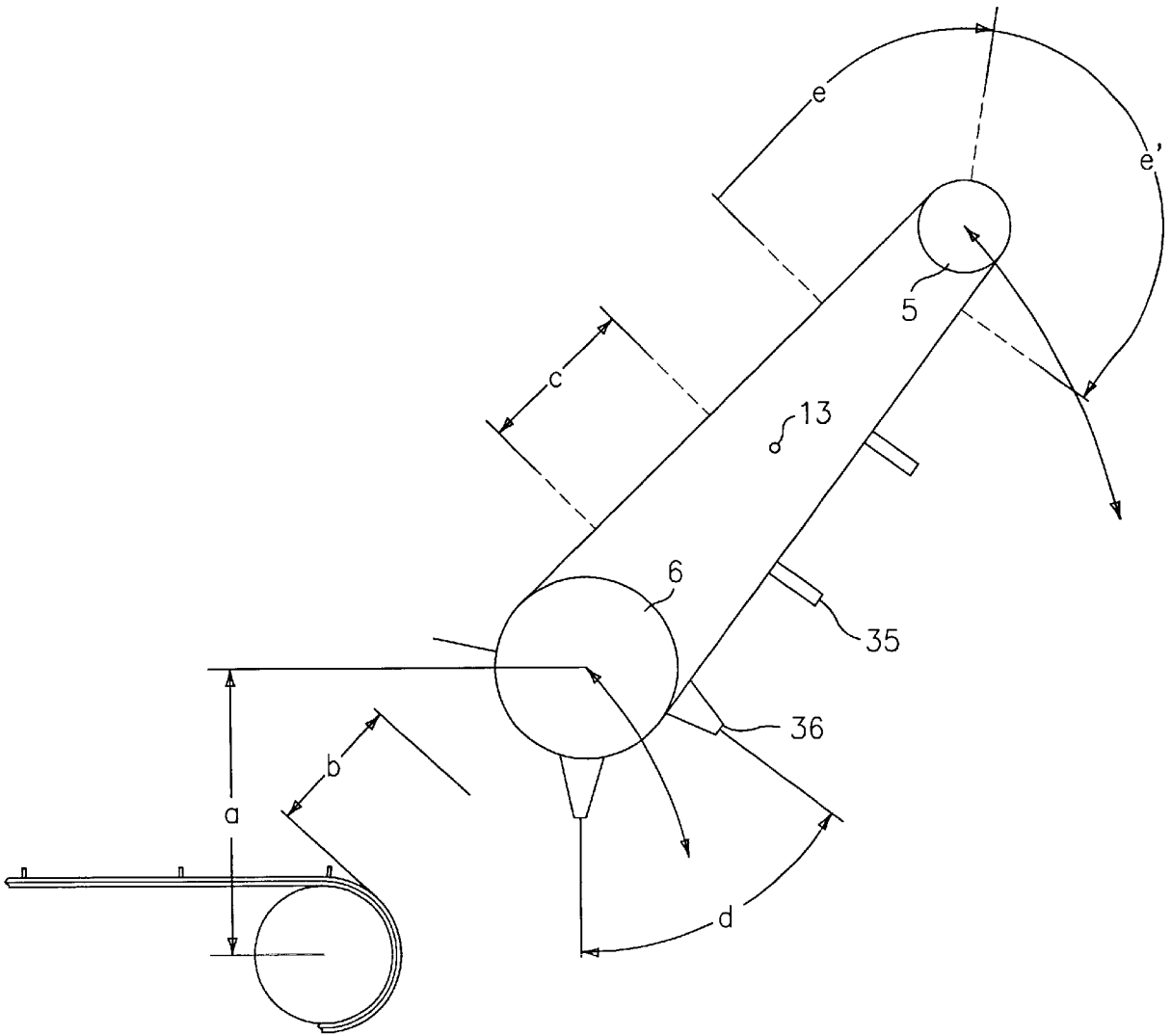
FIG. 3 is a simplified representation of FIG. 1.

From FIG. 3 it can be seen that in this embodiment the height of the lower deflection means 6 is adjustable with respect to the conveying means. For this purpose, the parameter a, which indicates the height of the axis of the lower deflection means 6 with respect to the axis of the deflection means 23 of the conveying means 4, can be set. Furthermore, also the distance b between the tip of the extracting prongs 4 and the conveying means 1 can be adjusted. It is to be noted that due to the different radiuses of the deflection means 5 and 6, the distance between the tips of the extracting prongs 4 varies strongly. On the straight tracks of the transport means, this distance c is smallest. At the lower deflection means 6, the distance d is already larger and it is largest in the area of the upper deflection means 5 (distance e or e'), since, due to the small radius, the extracting prongs 4 are spread widely. The entire unit can be pivoted about the pivot axle 13. Possible displacements of the deflection means 5 and 6 are diagrammatically indicated by the arrows.

Referring to FIG. 3, the following further developing features of the invention will be described. Irrespective of the other features shown in FIG. 3, these improve the extraction and discharge behavior of the extracting prongs 4. In the bottom portion, the extracting prongs 4 may be provided with a covering 35, 36 so that only the tips of the extracting prongs 4 project. This covering 35, 36 may be adapted to be cylindrical or frustoconical. In the latter case, the portion having the larger diameter is provided in the base of the extracting prongs 4 and the portion having a smaller diameter is provided in the upper portion of the extracting prongs 4. The covering 35,36 may also be formed by a plate-like element and a subsequent tubular element. The covering 35, 36 may also be formed integrally with the extracting prongs. For reasons of expediency, the root portion of the extracting prong 4 in which a spring may be provided (resilient prong) is covered by the covering so as to prevent extracted materials from getting stuck in the root portion.

The covering achieves the effect described in the following. The extracted materials rather remain in the upper portion of the extracting prongs 4, since their lowering is prevented by the step formed by the covering. The frustoconical shape furthermore has the effect that any materials which may have reached the bottom portion nevertheless can come off again more easily, since the clear space increases towards the top.

Figure 4:
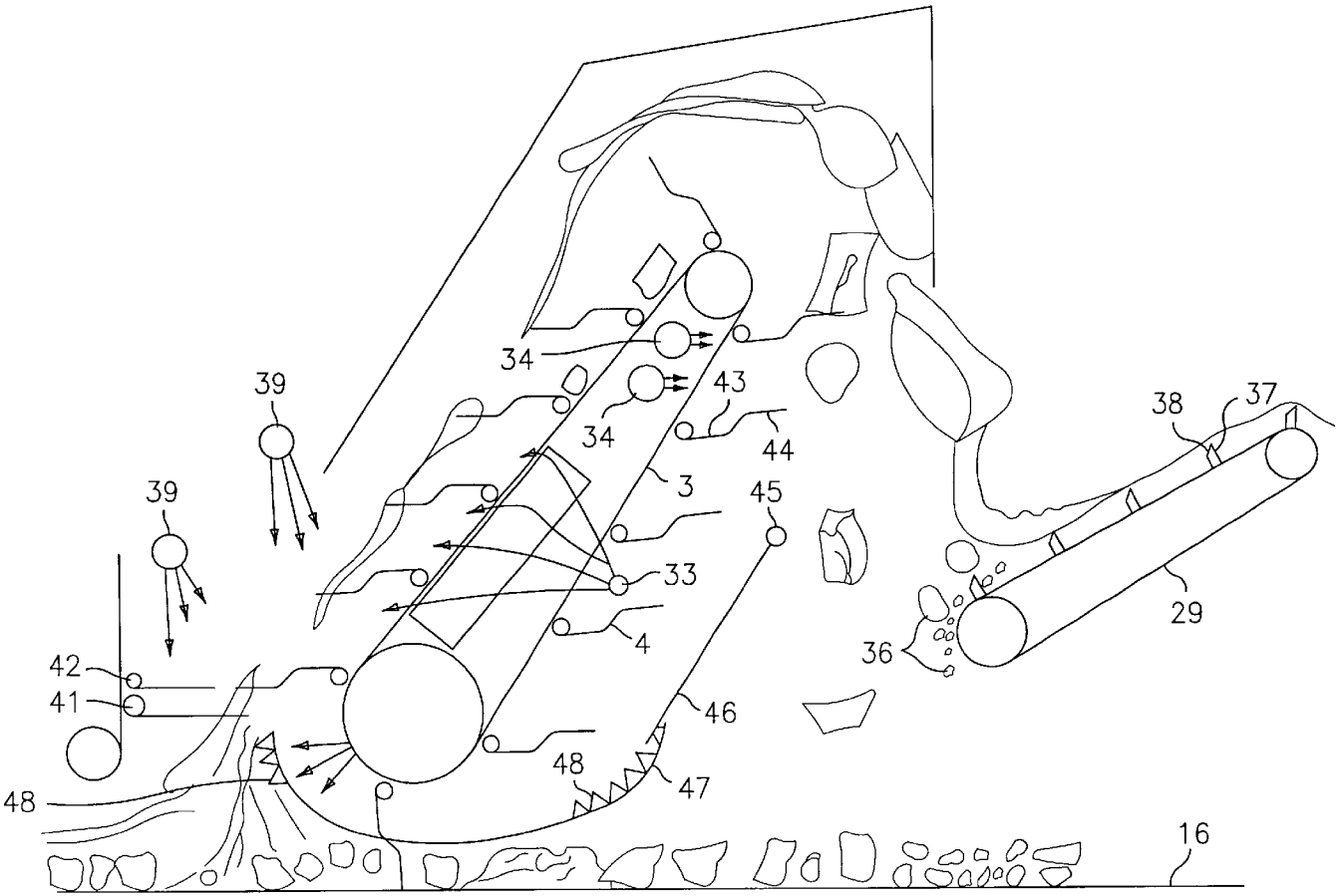
FIG. 4 is a further variant of the device shown in FIG. 1.

FIG. 4 shows a variant with modified extracting prongs 4 and another nozzle arrangement which, together with the modified extracting prongs 4, has produced excellent results with different mixtures of valuable substances. The extracting prongs 4 consist of two straight portions (inner portion 43, outer portion 44) which are aligned approximately in parallel in a manner offset with respect to each other and are connected to each other by a bent center portion. The arrangement of the extracting prongs 4 is such that the portion having the tip (outer portion 44) is displaced backwards against the transport direction. Due to this design of the prongs, the flat materials picked up in the pick-up zone, such as foils, are urged outwards, which, on the one hand, enables them to be discharged more easily and, on the other hand, results in that other objects which have also been picked up can fall down again more easily, since the flat objects which are in the outer portion do not prevent this.

In this embodiment, the extracting prongs 4 are resilient prongs which are fixed to the transport means 3 by coil springs and, when a force exceeding a predetermined value is applied, pivot to the left in the representation. The extracting prongs 4 are not aligned with the transport means 3 at an angle of 90°, but, in the way as shown, at an angle of smaller than 90° against the transport direction.

In addition to the nozzles shown in the embodiments already described above, further nozzles 33 and nozzles 34 are provided. The nozzles 33 are arranged in the upwardly directed part of the transport means 3 so as to remove objects which have also been picked up. In the embodiment, these nozzles 33 are only arranged in the lower part of the transport means 3. However, in a variant, they are provided over the whole upwardly directed part of the transport means 3. The nozzles 34 are arranged in a similar way in the upper area of the downwardly directed part of the transport means 3 and, on the one hand, improve the transfer of the flat materials to the conveyor belt 29 and, on the other hand, serve to loosen objects which may have got stuck at the extracting prongs 4.

Moreover, in the pick-up zone, additional nozzles 39 are provided which are fixed to a carrier, which is not represented, and blow downwards in the manner as shown so as to blow off objects which have been picked up together with the flat materials. By these nozzles 39 and the nozzles 33, a cleaning of the flat materials is, in a way, achieved and it is not only smaller objects but also dirt that is removed.

In a similar manner as in the embodiment according to FIG. 1, strippers are provided in the pick-up zone which have the same function as the stripper 21 shown in FIG. 1. The strippers realized in this embodiment are a plurality of resilient prongs 41, 42 which are pivotable in the transport direction against the force of a coil spring. The upper resilient prongs 41 are arranged opposite to the extracting prongs 4 and their length is dimensioned such that the tips just about fail to touch each other. Laterally offset with respect to them and somewhat lower arranged are the lower resilient prongs 42 which are designed to be longer so that at least the tip of the extracting prongs 4 runs past them. Since the lower resilient prongs 42 are laterally offset with respect to the extracting prongs 4, the prongs do not collide.

Larger objects 35 which have also been picked up drop off the transport means 3 onto the conveyor belt 16. Smaller objects 36 which have likewise been picked up also drop off the inclined, upwardly directed conveyor belt 29 onto the conveyor belt 16. The conveyor belt 29 is provided with knobs 37 which, in this embodiment, have a tapered tip whose tapered surface 38 slopes down against the transport direction. Due to these knobs 37, the flat materials can be conveyed reliably without smaller objects being hindered from falling down.

On the right-hand side of the transport means, a rotatable roll or roller 45 is arranged which is followed by a return sheet 46. A plurality of rolls or rollers may also be provided side by side. The lower end of this fixedly arranged return sheet 46 is, in turn, connected to a resilient guide 47 which is designed like a leaf metal spring and is arranged between the extracting prongs 4 so that the extracting prongs 4 run past this guide 47. The guide 47 may consist of an element designed like a leaf metal spring or of a plurality of elements arranged side by side. Due to the resilient construction, the guide can be deflected downwards so as to let pass larger objects which have come between guide and transport means. In this embodiment, ripping means 48 are provided in the intake area on the inner side of the guide 47 as well as on the opposite end of the guide 47 on the outer side thereof. However, these ripping means 48 may also be arranged in a different manner. The ripping means 48 are formed as blade-like projections.

If flat materials are not, as intended, transferred to the conveyor belt 29, they drop down onto the roll 45. Due to the fact that the roll 45 is rotatably supported, the materials cannot get caught but either roll to the inner left of the return sheet 46 or to the right of the sheet and fall back onto the conveyor belt conveying the substance mixture. If the materials drop to the left of the return sheet 46, they are further transported by the extracting prongs 4 inside the guide 47, that is to say between the guide 47 and the transport means 3. During this kind of further conveyance, the materials are ripped by the ripping means 48.

If larger objects are conveyed along, the resilient guide 47 can be deflected downwards so that blockage of the device can be prevented. Also on the bottom side of the guide 47, ripping means 48 are provided which rip the objects, in particular the flat materials, extracted in the extraction zone.

Figure 5:
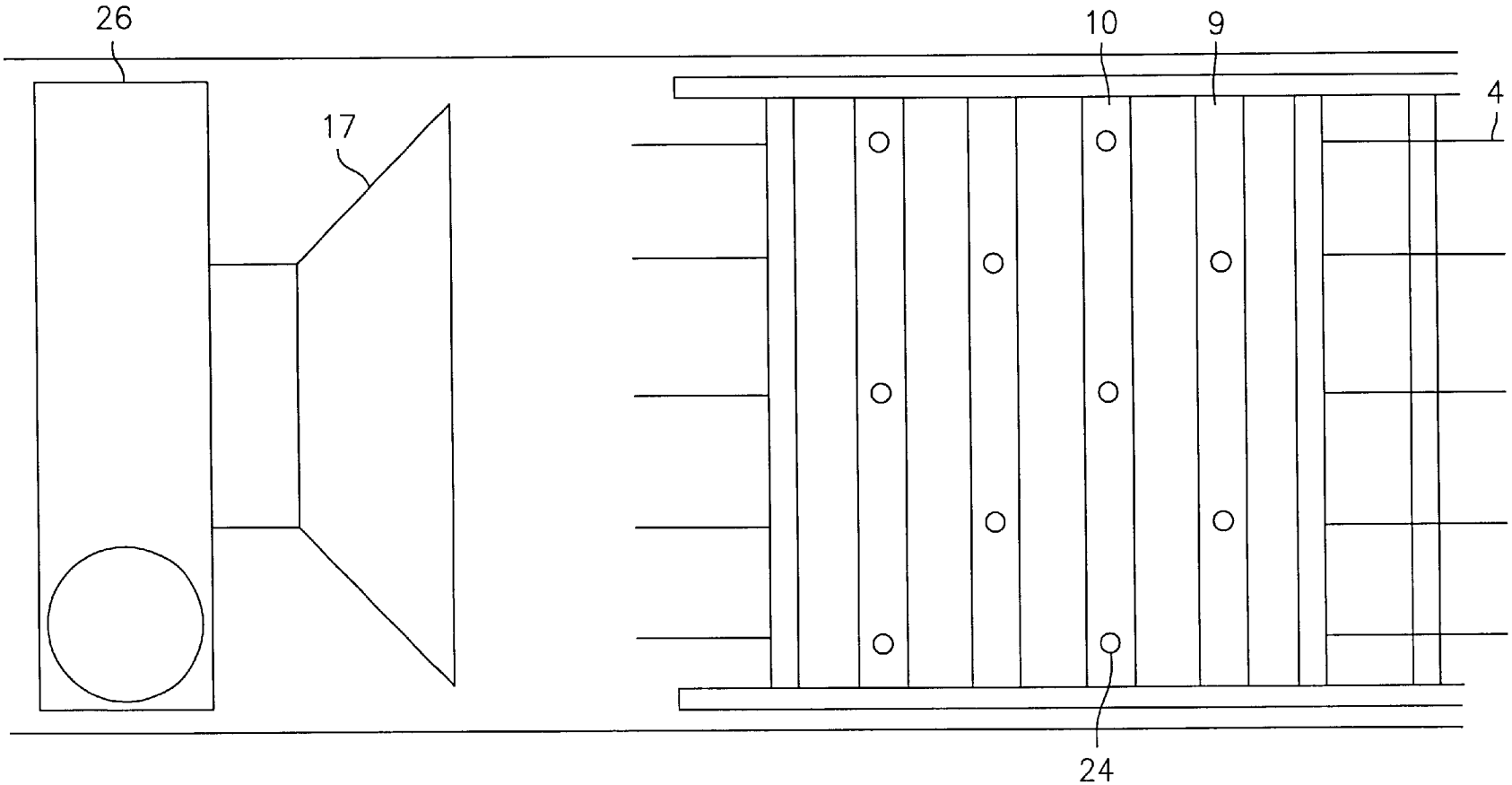
FIG. 5 is a top view of the discharge zone of the device shown in FIG. 1.

FIG. 5 shows a top view of the transport means 3 in the discharge zone, i.e. in the area of the nozzle bars 9, 10. The nozzle bars 9, 10 extend over the entire width of the transport means 3. In FIG. 1, only two bars are drawn in so as to simplify the drawing, whereas in FIG. 4, three nozzle bars can be seen. In this embodiment, the nozzles 24 are provided at a position where the extracting prongs 4 pass, as well. In the represented position of the transport means, an extracting prong 4, which is not represented, is arranged directly above each nozzle 24. The extracting prongs 4 are arranged transverse to the transport direction in a manner offset with respect to each other, and rows of four extracting prongs 4 alternate with rows of five extracting prongs 4. In the top view, also the intake 17 of the suction means 26 can be seen. Behind the funnel-shaped intake 17, rejecting surfaces are provided which serve to guide the objects falling down behind the intake 17 of the suction means 26 past the suction means 26 to the conveying means 1.

Figure 6:
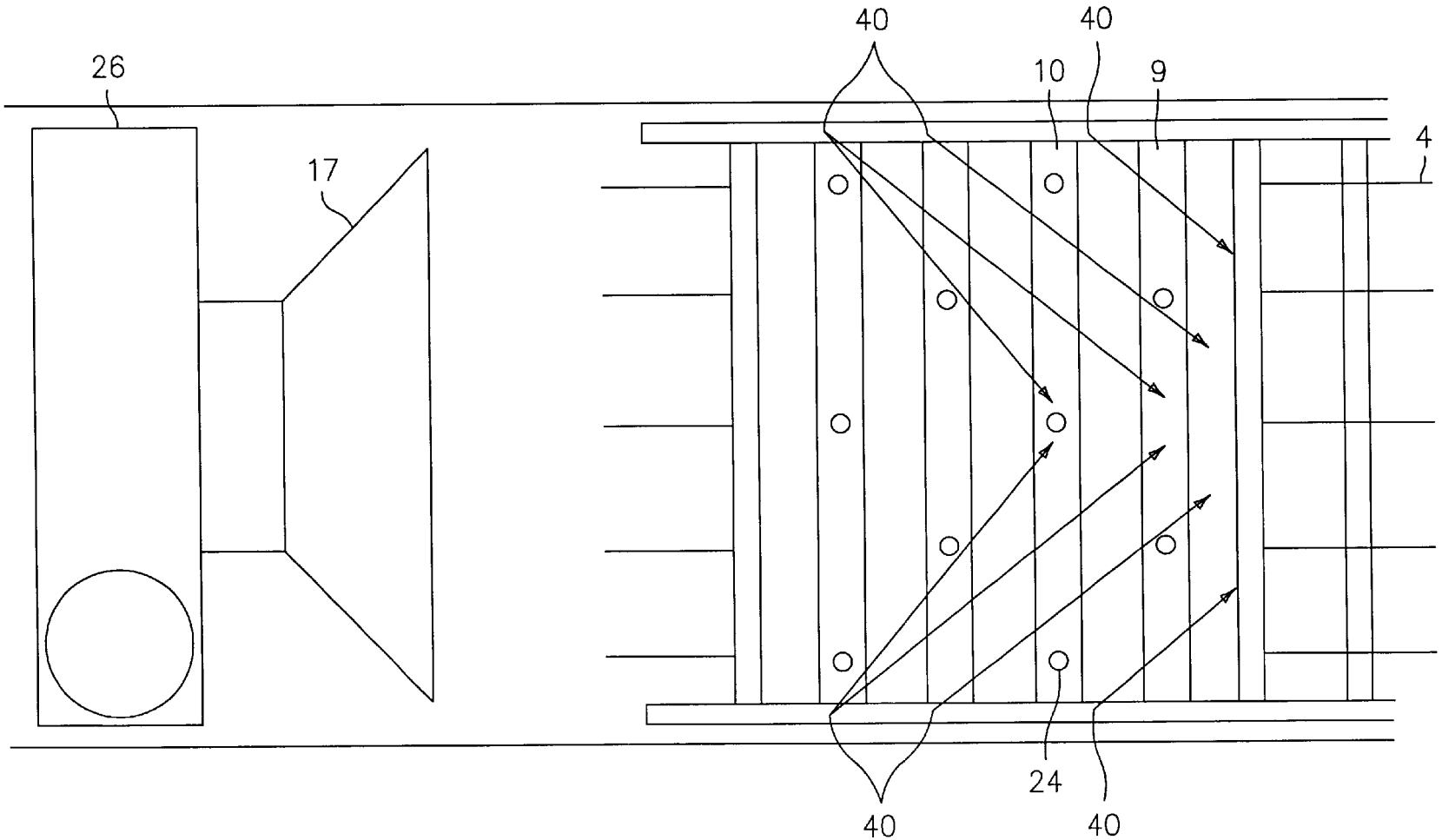
FIG. 6 is a variant of the discharge zone shown in FIG. 5.

In the variant of the discharge zone shown in FIG. 6, an air flow directed diagonally downwards is achieved by means of nozzles 40 additionally provided on the side of the conveying area. This air flow improves the discharge of objects and in particular prevents objects from getting stuck at the extracting prongs 4.

Figure 7:
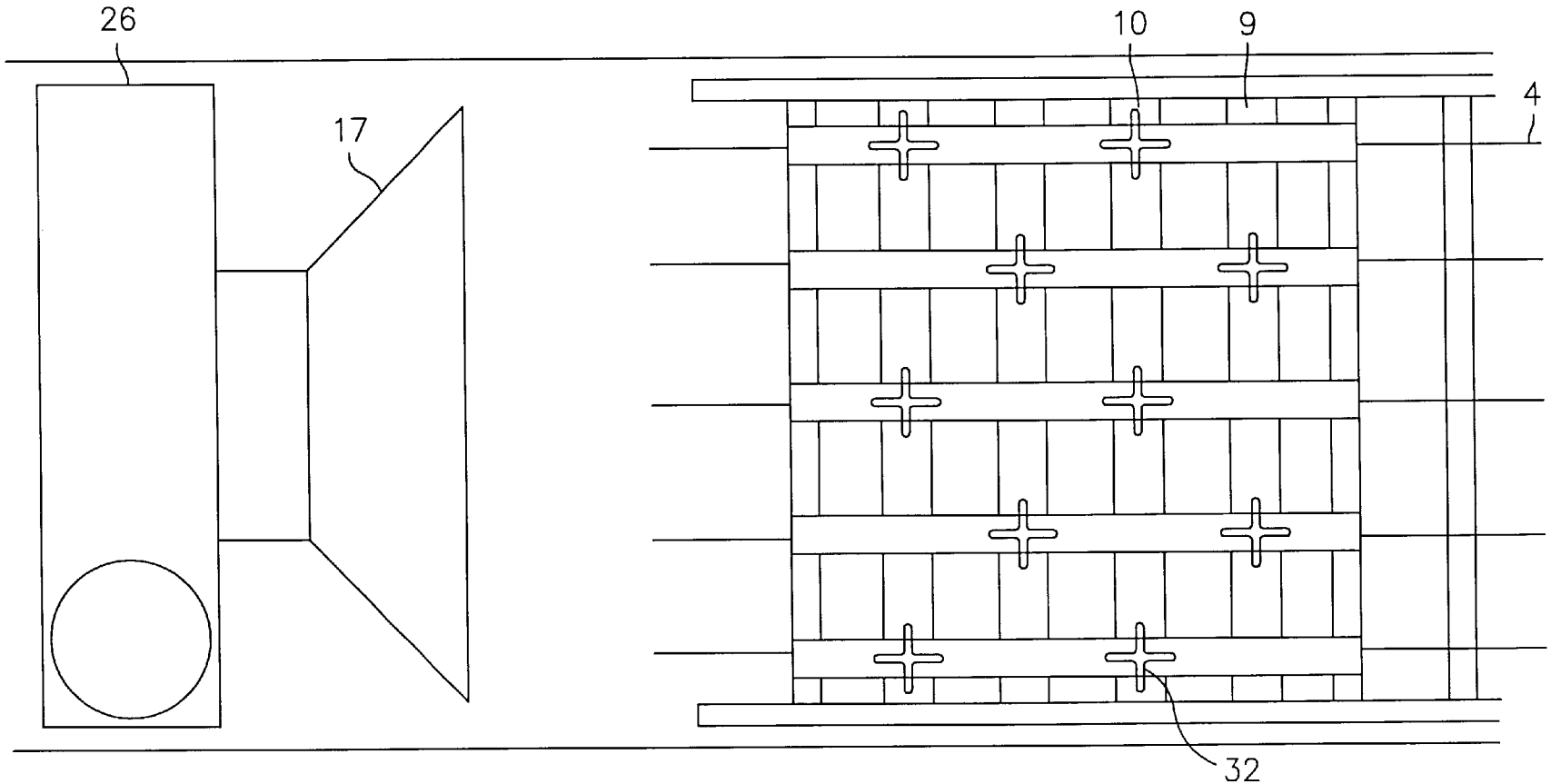
FIG. 7 is the top view of a modified device according to FIG. 3.

FIG. 7 basically corresponds to FIGS. 5 or 6 and shows a modification of the described embodiment. In this modification, the nozzle bars are not only arranged transverse to the transport direction but longitudinally and transverse thereto. The nozzles are formed as oblong cross-shaped slots 32 so that blowing on the extracting prongs 4 can be effected over a predetermined transport path which corresponds to the length of the slots.

The blower 11 provided at generates a pulsating air flow so that the air is discharged in a pulsating manner from the nozzles of the nozzle bars.

In the following, with reference being made to FIG. 1, the way the device works will be described in detail. A mixture of valuable materials arriving from the left-hand side is delivered on the conveying means 1. The substance mixture passes the baffle sheet 19 and is loosened by the prongs 20 on the surface. The extracting prongs 4 running in the opposite direction of the conveying means 1 extract flat materials from the mixture of valuable substances in the extraction zone. By dimensioning the distance between the extracting prongs 4, the device can be adjusted to the delivered mixture of valuable substances, i.e. to the materials to be extracted.

The smaller the distance, the smaller the objects which are extracted.

The materials extracted by the extracting prongs 4 are transported past the nozzles of the nozzle bars 7 and 8 which blow on the materials from both sides. By this blowing, substances adhering to the materials, such as smaller foil portions, are blown off and fall back onto the conveying means 1.

Subsequently, the extracted materials pass the stripper 21 By this stripper, larger substances still adhering to the materials are stripped off and fall back onto the conveying means 1. Loose, lighter objects are removed by suction. The device shall remove flat materials. However, when other materials are extracted by the extracting prongs 4, these materials are again removed from the extracting prongs by the stripper 21. Since there is, in principle, the possibility that the device is blocked when the extracting prongs 4 pick up bulky bodies which cannot be stripped off by the stripper 21, the stripper 21 is formed to be flexible and pivots away when a predetermined force Is exceeded. The materials which have been picked up are further transported by the transport means 3. When the upper deflection means 5 is passed, the extracting prongs are spread apart. By this, the holes which may have been pierced into these materials by the engagement of the extracting prongs 4 are enlarged, which particularly applies to foils and cardboard boxes. Moreover, the tension of materials, such as foils, which lie on the extracting prongs 4, will change due to the different expansion, by which the discharge is facilitated.

After the upper deflection means 5 has been passed, the extracting prongs 4 reach the discharge zone in which they are not spread apart and their tips show the minimum distance. Thus, due to this return movement of the tips, the materials are loosened from and fall off the extracting prongs 4 which, in the discharge zone, are directed downwards. This is assisted by the blowing out of air from the nozzles of the nozzle bars 9, 10.

Heavier substances are not carried along by the air flow and slide down directly onto the conveyor belt 16, if possible via the chute 15. Light substances which, like the flat materials, are carried along by the air flow are, just as substances which are carried along on the materials, not sucked in by the intake of the suction means 26, but fall down onto the conveyor belt 16 behind the intake. So as to ensure that the suction means 26 actually only sucks in the substances to be removed, the distance between the intake of the suction means 26 and the transport means 3 is adjustable. Furthermore, the suction capacity may be adjustable.

In another embodiment, which is not represented, no suction means 26 is used. Instead, after having slid down the baffle plate 14, the flat materials are conveyed away by a conveying system. In the normal case, all materials that are unwanted are already removed from the flat materials when the baffle plate 14 is reached so that the latter can simply be conveyed away.

In the case of systems for processing mixtures of valuable substances, the blocking of the system has to be avoided in any case, if possible. The device is frequently blocked by bulky, solid objects which are contained in the substance mixture. In the described device, such a blocking could already occur when such an object has to pass the baffle sheet 19. For this reason, the whole unit carrying the baffle sheet 19 is designed so as to be pivotable about the pivot axle 13. Due to the round contour provided on the bottom side of the baffle sheet 19, an upwardly directed force component is generated by the pressure exerted by an object on the baffle sheet 19, the force component urging the unit carrying the baffle sheet 19 upwards when a release force is exceeded.

Then, the object will reach the transport means and will be seized by the extracting prongs 4. Since the extracting prongs 4 can resiliently pivot away to the back, the object can, without the device being blocked, be further transported and falls down onto the conveyor belt 16. If the object is so large that, even if the extracting prongs 4 pivot away, it cannot pass below the transport means, the whole transport means pivots to the left about the pivot axle 13 in FIG. 3, by which the distance between transport means and conveying means 1 can be increased to such an extent that the object can pass in any case and falls down onto the conveyor belt 16.

The variant shown in FIG. 8 largely corresponds to the variant according to FIG. 2, with the whole unit being inclined to the other side and the extracted materials being conveyed away by a conveyor belt 29 which conveys against the conveying direction of the conveying means. The other components of the device correspond to those described by the preceding figures and were omitted in the drawing for the sake of clarity. This variant has the advantage that, when the materials are extracted, substances that have also been picked up but are not wanted more easily fall back onto the conveying means 1.

Although the materials are discharged before the second deflection means 5 is passed so that the extracted materials are not loosened by the second deflection means and the extracting prongs 4 are not spread, the discharge can be caused by blowing a fluid, such as air or a liquid, at the materials through nozzles.

What is claimed is:

1. An assembly for removing flat materials from a mixture of substances, said assembly comprising:

a) a movable incoming conveyor on which the substance mixture is initially conveyed;

b) a movable extractor assembly which is operative to extract flat materials from the substance mixture on said incoming conveyor, said extractor assembly comprising:

i) a movable endless belt;

ii) sets of spaced-apart tooth-like prongs which are mounted on said endless belt in a predetermined spaced apart relationship along said endless belt; and iii) at least a pair of cylindrical deflectors on which said endless belt is journaled, said deflectors including a larger diameter deflector which is disposed in close enough proximity with said incoming conveyor so as to allow said prongs to sweep over said incoming conveyor, and a smaller diameter deflector which is disposed distal of said incoming conveyor, said deflectors being operable to move said endless belt and said prongs in a direction which is counter to the direction of movement of said incoming conveyor and in a direction which is skewed angularly upwardly relative to the direction of movement of said incoming conveyor;

c) first means for applying air pressure to the substance mixture being conveyed on said incoming conveyor, said first means for applying air pressure being disposed adjacent to said larger diameter deflector, said first means for applying air pressure being operative to pneumatically separate flat materials from the mixture of substances on said incoming conveyor and deposit the flat materials on said extractor assembly endless belt whereby said prongs can carry the separated flat materials toward said smaller diameter deflector, said smaller diameter deflector being operative, by reason of its size to temporarily separate said prongs as said endless belt passes over said smaller diameter deflector;

d) a flat material discharge assembly disposed proximal to said smaller diameter deflector, said discharge assembly being operative to receive flat materials which are dislodged from said endless belt;

e) second means for applying air pressure to said endless belt, said second means for applying air pressure being disposed proximal to said smaller diameter deflector, said second means for applying air pressure being operative to dislodge flat materials from said endless belt and prongs and to direct the dislodged flat materials toward said discharge assembly; and f) a movable outgoing conveyor disposed below said smaller diameter deflector whereby materials on said endless belt which are not deflected toward said discharge assembly will fall onto said outgoing conveyor.

2. The assembly of claim 1 wherein said outgoing conveyor is disposed adjacent to said incoming conveyor so that materials in the substance mixture which are not deposited on said endless belt will be deposited on said outgoing conveyor.

3. The assembly of claim 1 wherein said incoming conveyor and said outgoing conveyor are the same conveyor.

4. The assembly of claim 1 wherein said prongs are pivotally mounted on said endless belt.

5. The assembly of claim 1 wherein the positions of said prongs on said endless belt can be moved both lengthwise and transversely on said endless belt.

6. The assembly of claim 1 wherein said first and second means for applying air pressure are operative to produce pulsating air streams.

7. The assembly of claim 1 wherein root portions of said prongs are provided with coverings having a larger diameter than said prongs so as to prevent flat materials impaled on said prongs from reaching said root portions of said prongs.

8. The assembly of claim 1 wherein said discharge assembly includes a vacuum source for drawing dislodged flat materials into said discharge assembly.

9. The assembly of claim 1 wherein said discharge assembly includes a discharge conveyor for transporting flat materials away from said moving endless belt.

10. The assembly of claim 9 wherein said discharge conveyor is movable in essentially the same direction as the direction of movement of said endless belt.

11. The assembly of claim 9 wherein said discharge conveyor is movable in a direction which is counter to the direction of movement of said incoming conveyor.

12. The assembly of claim 1 wherein said first and second means for applying air pressure are adjustable in a blowing direction.

13. The assembly of claim 1 further including a baffle plate between said endless belt and said discharge assembly for deflecting dislodged flat materials toward said discharge assembly.

14. The assembly of claim 13 wherein said baffle plate is pivotably adjustable relative to said discharge assembly.

15. The assembly of claim 1 further comprising a stripper which is mounted above said incoming conveyor and which is operative to remove non-flat objects from said prongs in the event that such non-flat objects are engaged by said prongs.

16. The assembly of claim 15 wherein said stripper is pivotable away from outer ends of said prongs to avoid jamming of said prongs and said endless belt.

* * * * *